US005465703A

United States Patent [19]

Abe

[11] Patent Number: 5,465,703

[45] Date of Patent: Nov. 14, 1995

[54] CONTROL METHOD FOR PURGING FUEL VAPOR OF AUTOMOTIVE ENGINE

[75] Inventor: Kiyomi Abe, Kokubunji, Japan

[73] Assignee: Fuji Jukogyo Kabushiki Kaisha, Tokyo, Japan

[21] Appl. No.: 79,909

[22] Filed: Jun. 23, 1993

[30] Foreign Application Priority Data

Jul. 9, 1992 [JP] Japan ..... 4-182534

[51] Int. Cl.[6] ..... F02M 41/14

[52] U.S. Cl. ..... 123/674; 123/698; 123/520

[58] Field of Search ..... 123/674, 698, 123/520

[56] References Cited

U.S. PATENT DOCUMENTS

| | | | |
|---|---|---|---|
| 4,748,959 | 6/1988 | Cook | 123/520 |
| 4,831,992 | 5/1989 | Jundt et al. | 123/698 |
| 4,869,223 | 9/1989 | Shimomura et al. | 123/698 |
| 4,977,881 | 12/1990 | Abe et al. | 123/674 |
| 5,048,492 | 9/1991 | Davenport et al. | 123/674 |
| 5,070,847 | 12/1991 | Akiyama et al. | 123/674 |
| 5,072,712 | 12/1991 | Steinbrenner et al. | 123/698 |
| 5,085,194 | 2/1992 | Kuroda et al. | 123/520 |
| 5,090,388 | 2/1992 | Hamburg et al. | 123/674 |
| 5,150,686 | 9/1992 | Okawa et al. | 123/698 |
| 5,216,995 | 6/1993 | Hosoda et al. | 123/520 |
| 5,230,319 | 7/1993 | Otsuka et al. | 123/520 |
| 5,245,978 | 9/1993 | Orzel | 123/674 |
| 5,257,613 | 11/1993 | Monda et al. | 123/674 |
| 5,299,546 | 4/1994 | Kato et al. | 123/698 |

*Primary Examiner*—Thomas N. Moulis

*Attorney, Agent, or Firm*—Beveridge, DeGrandi, Weilacher & Young

[57] ABSTRACT

A method for controlling canister purge of an internal combustion engine is disclosed. Based on a change rate of an air-fuel ratio correction coefficient per unit duty, a canister loading ratio is assumed by looking up a map. Further based on the canister loading ratio, a correction amount to the purge control duty for controlling the purge amount from the canister is determine. It is therefore possible to control a canister purge in accordance with the canister loading amount, whereby an over-loading of the canister can be prevented even under a high evaporation condition such as at extremely high temperatures or high altitudes. A deviation of the air-fuel ratio caused by the canister purge can be calculated, whereby an improvement in startability, driveability and emissions can be achieved by updating air-fuel ratio learning values with new learning values excluding a deviation of the air-fuel ratio caused by the canister purge.

8 Claims, 9 Drawing Sheets

CAN. PURGE CONT. ROUTINE
S101
NE>NSI
NO
YES
S102
TM←0
S103
TM<TMCAN
NO
YES
S104
TM←TM+1
S105
VSP<VSPCP
NO
YES
S106
ME<RPMCP
NO
YES
S107
THROTTLE FULL CLOSE
NO
YES
S108
DUTY←0
S109
SET BASIC DUTY CPCD FROM NE,Tp
S110
DUTY←CPCD+DCOEF
S111
DUTY<DMIN
NO
YES
S112
DUTY←DMIN
S113
DUTY>DMAX
NO
YES
S114
DUTY←DMAX
SET DUTY
S115
S116
CANT≧CTM
YES
NO
2
S117
CTM←CTM+1
RTS

CONTROL METHOD FOR PURGING FUEL VAPOR OF AUTOMOTIVE ENGINE

BACKGROUND OF THE INVENTION

The present invention relates to a method for controlling vaporized fuel generated from the fuel tank of an automobile and more particularly to a method for purge control of the vaporized fuel stored in a charcoal canister. In a conventional vehicle, for the purpose of preventing vaporized fuel or fuel vapor in the fuel tank from being emitted outside, an evaporative emission control system is widely used. In the evaporative emission control system, fuel vapor is guided to a charcoal canister and is adsorbed therein. The adsorbed fuel vapor is sucked into the intake system of an engine and then it is burned together with the mixture gas in the combustion chamber. The process of fuel vapor being sucked into an engine is called "canister purge."

However, generally speaking, this canister purge causes a deviation as much as an amount of fuel vapor discharged into the intake air passage in air-fuel ratio because the air-fuel ratio is determined depending on the amount of intake air. To solve this problem, for example, Japanese patent application laid open No.1988-18175 discloses a technology to control a canister purge without having an effect on the air-fuel ratio.

This patent application proposes:

When fuel vapor is supplied to the intake air passage at an operational point, the allowable amount of fuel vapor is judged and based on the judged amount and the supplied amount of fuel vapor is adjusted to the allowable amount. Throughout all operations in the same way the supplied amount is adjusted to the allowable amount. As a result of this it becomes possible to discharge fuel vapor into the intake air passage without having an effect on the feedback control.

As well known, in an air-fuel control for the conventional engine, a learning control system has been introduced so as to correct a deviation of air-fuel ratio derived from production scatterings or deteriorations in such components as an induction air flow sensor, a fuel injector and other components as quickly as possible and further so as to keep air-fuel ratio at a desired value even when the engine operating condition is largely changed. That is to say, at the previous running of engine, a deviation of the centerline for so-called LAMDA control coefficient is memorized on a map and at the present running, fuel injection amount is corrected by referring the deviation memorized on the map, whereby air-fuel ratio is controlled properly.

In a prior art, the amount of canister purge is so designed to be fixed at a set value regardless of the loading condition of canister with fuel vapor that when a canister purge is performed in conditions of a canister fully loaded with fuel vapor, such as under a high ambient temperature condition or at a high altitude running, air-fuel ratio deviates to the rich side and on the other hand, when a canister purge is done in a condition of a canister less loaded with fuel vapor, air-fuel ratio deviates to the lean side. As a result of this, the air-fuel ratio feedback control recognizes above deviations as those of the standard value of an air-fuel ratio feedback correction coefficient $\partial$ and the learning value which is stored in a map is updated to the rich or lean sides with the new standard value of $\partial$ which has been corrected by those deviations. This updated learning value is used even when a canister purge is not performed, so that air-fuel ratio becomes inappropriate and consequently poor driveability and inferior emissions are caused.

SUMMARY OF THE INVENTION

It is an object of the present invention to provide a method for preventing an adverse effect on air-fuel ratio control by controlling the purge amount of vaporized fuel properly according to the loading condition of the canister.

It is another object of the present invention to provide a method for avoiding an adverse effect on air-fuel ratio control by eliminating a deviation of air-fuel ratio learning value derived from canister purge so as to use basic learning values purely originated from secular changes or production scatterings in components.

According to the present invention, there is provided a method for controlling air-fuel ratio of an internal combustion engine having a purge control system to feed vaporized fuel stored in a charcoal canister to an engine appropriately and a learning control method in the feedback control system so as to control air-fuel ratio correctly under any operating conditions.

The method comprises the steps of, assuming with an appropriate time interval a canister loading rate (%) from a change rate an air-fuel rate correction coefficient in varing the purge amount of fuel vapor for a specified time in an engine steady operating condition, determining the purge amount of fuel vapor based on said assumed canister loading rate, controlling a canister purge according to the assumed canister loading ratio, calculating a deviation of air-fuel ratio learning value derived from said canister purge for all addresses at an engine stop, averaging said deviations of air-fuel ratio learning value, subtracting said averaged deviation value from an air-fuel ratio correction learning value for all addresses, and updating said air-fuel ratio correction learning value with said subtracted air-fuel ratio correction learning value for each corresponding address.

In summary, according to the present invention, a good startability, a smooth running and a steady emissions performance are provided.

DETAILED DESCRIPTION OF PREFERED EMBODIMENTS

Figure 7:
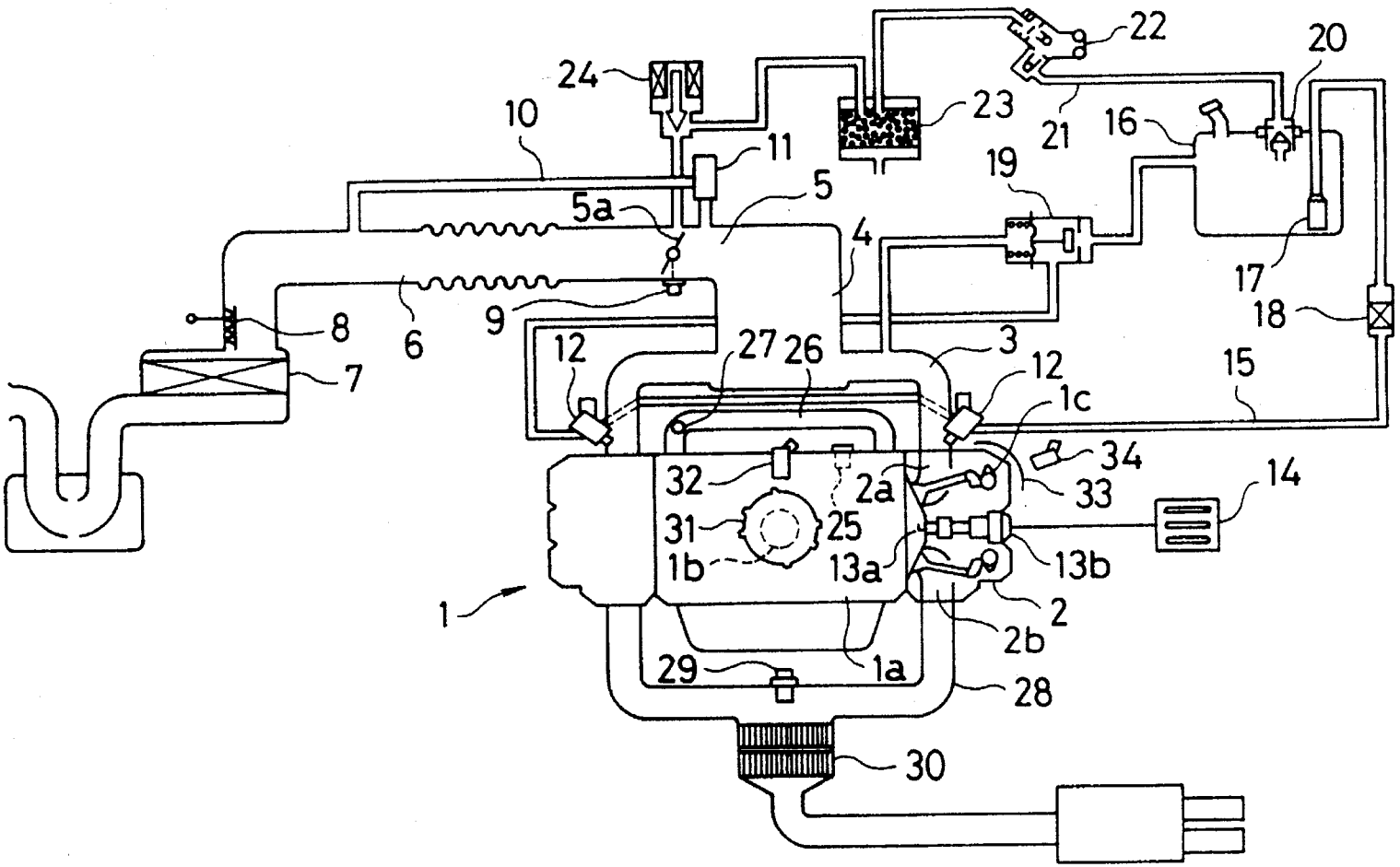
FIG. 7 is a schematic diagram showing the engine control system.

Referring to FIG. 7, reference numeral I denotes an engine. In this reference, the engine illustrates a horizontally opposed four cylinder engine. An intake port 2*a* is incorporated in a cylinder head 2 of the engine. An intake manifold 3 is mounted on the cylinder head 2 and connected to the intake port 2*a*. A throttle chamber 5 is communicated with the intake manifold 3 via an air chamber 4. An air cleaner 7 is provided upstream of the throttle chamber 5 through an induction conduit 6.

Right downstream of the air cleaner 7, an air flow sensor (in this embodiment a hot wire type of air flow sensor) is provided and further a throttle sensor 9 is connected with a throttle valve 5*a* installed in the throttle chamber 5. An idle speed control (ISC) valve is disposed at a bypass passage 10 communicating between the upstream and the downstream of the above throttle valve 5*a* and a fuel injector 12 is arranged right upstream of the induction port 2*a* for each cylinder. A spark plug 13*a* per each cylinder is provided with its tip protruding into a combustion chamber and an igniter 14 is connected to an ignition coil 13*b* communicating with a spark plug 13*a*. The fuel injector 12 is communicated with a fuel tank 16 via a fuel supplying system 15. In the fuel tank 16, a fuel pump 17 (in this embodiment an intank type) is installed. Fuel pressurized by the fuel pump 17 is fed to the fuel injector 12 and a pressure regulator 19 via a fuel filter 18 and is regulated to a specified pressure by the pressure regulator 19, returning to the fuel tank 16. On the fuel tank 16 a fuel cut valve 20 composed of a float valve is installed and a fuel vapor passageway 21 is extended from the fuel cut valve 20. In this fuel vapor passageway a roll-over valve 22 in which two ball type valves and a 2-way valve are integrated is equipped and is communicated with a canister 23 having an adsorbing substance such as activated charcoal therein. Furthermore, this canister is communicated to the induction system of engine (right downstream portion of the throttle valve) through a canister purge control (CPC) valve 24 which is composed of a linear solenoid valve.

The fuel vapor generated in the fuel tank 16 is discharged into the fuel passageway 21 after a liquid portion of the vaporized fuel being separated by the fuel cut valve 20. When the pressure of the discharged fuel vapor exceeds a determined value of the 2-way valve in the roll-over valve 22, the fuel vapor is adsorbed in the activated charcoal of the canister 23 via the 2-way valve. The fuel vapor stored in the canister 23 is conducted to the induction system via the above CPC valve 24 and inhaled into a combustion chamber of the engine. The CPC valve 24 abovementioned is controlled according to the duty ratio signal transmitted from an electronic control device 41 mentioned hereafter and in this embodiment the valve opening of the CPC valve 24 is designed to become large with an increase of the duty ratio.

The abovementioned roll-over valve acts as a safety device to prevent fuel leakage from the fuel tank 16 by means of two ball valves in case for a roll-over accident of a vehicle and also acts as a means for protecting the fuel tank 16 from being deformed by a vacuum pressure, namely the pressure in the fuel tank is kept within a specified range by a breathing operation of the roll-over valve that fuel vapor is released to the canister when the pressure in the fuel tank is above a set pressure and it is conducted into the fuel tank when the pressure in the fuel tank becomes below a set pressure.

There are provided a knock sensor 25 on a cylinder block 1*a* of the engine 1 and a coolant temperature sensor 27 with its tip exposing in a coolant passage 26 which communicates the right and left banks of the cylinder block 1*a*. Further, an oxygen ($O_2$) sensor 29 and a catalytic converter 30 are equipped at the fork portion of an exhaust manifold 28.

A crank rotor 31 is coupled coaxially with a crank shaft 1*b* mounted on the cylinder block la and on the periphery of the crank rotor 31 a plurality of projections (or slits) are provided. A crank angle sensor 32 (an electromagnetic pick up type in this reference) to detect crank angles is provided against these projections. Further, a cam angle sensor 34 (an electromagnetic pick up type in this reference) for discriminating. cylinder numbers is provided against a cam rotor 33 which is connected coaxially with a cam shaft 1*c*. The abovementioned crank angle sensor 32 and the cam angle sensor 34 may be an optical type, not limiting to an electromagnetic type.

Figure 8:
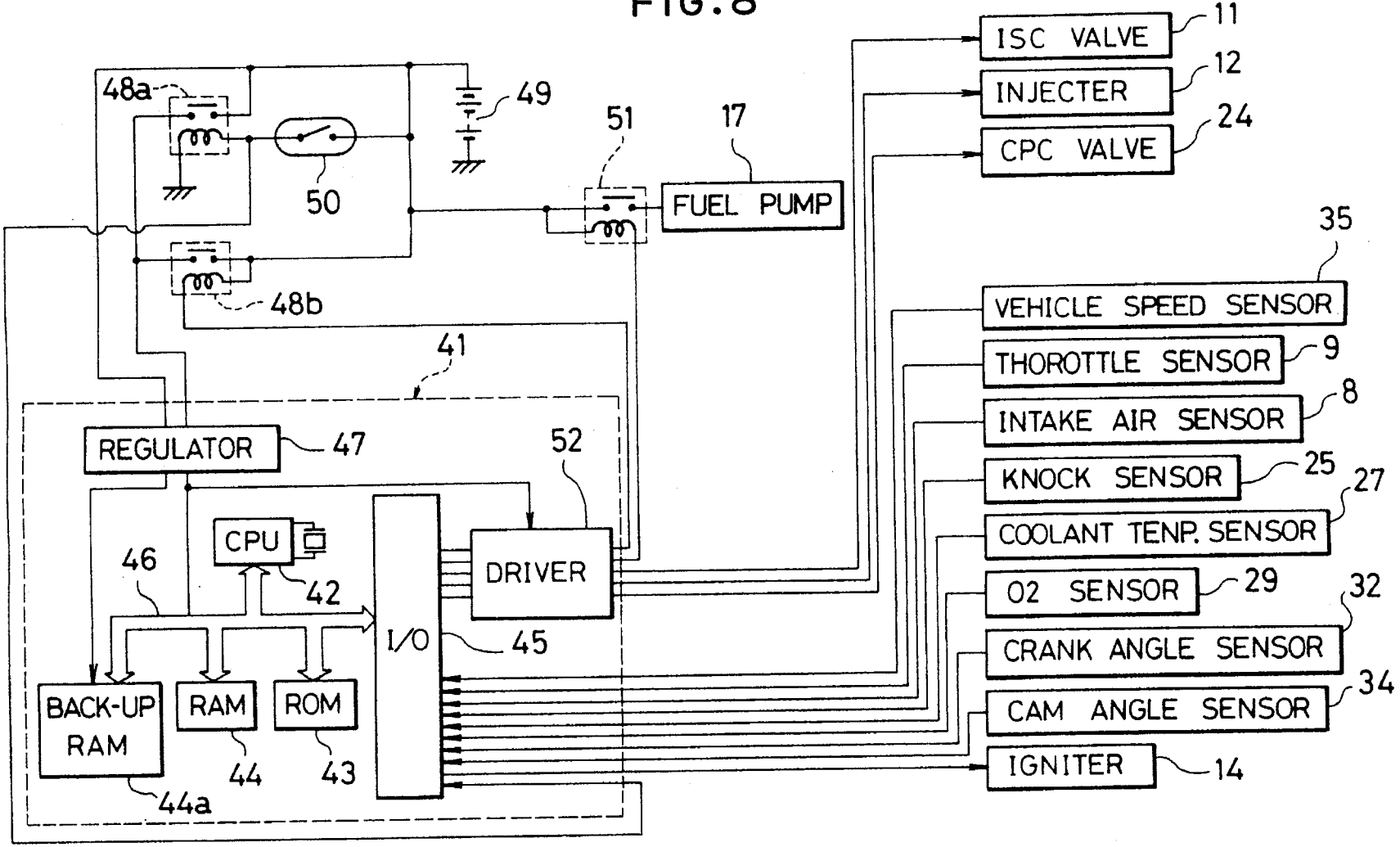
FIG. 8 is a diagrammatic view of the electronic control system.

On the other hand, referring to FIG. 8, a reference numeral 41 denotes an electronic control unit (ECU) in which there are provided a CPU 42, a ROM 43, a RAM 44, a backup RAM 44*a*, an I/O interface 45 and a bus line 46 which connects all together. A reference numeral 47 shows a regulator to supply a specified constant voltage to the ECU. The regulator 47 is connected to a battery 49 via the relay contact point of an ECU relay 48*a* and the one of an a self-shut relay 48*b* (power holding relay) respectively whose relays both are arranged in parallel. These relays are provided for supplying power to the ECU 41 when either the ECU relay 48*a* or the self-shut relay 48*b* closes its contact. The battery 49 is connected to a relay coil of the ECU relay 48*a* via an ignition key switch 50 and further connected to a relay coil of a fuel pump relay 51 through which a fuel pump 17 is connected. The above self-shut relay 48*b* is turned "ON" by the ECU 41, where the ignition key switch 50 is turned on and it is kept "ON" by the ECU 41 until exceeding a predetermined time. Namely, the ECU 41 is supplied with electric power for a predetermined time even after the ignition switch is turned off and an engine is stopped in order to carry out miscellaneous processes such as letting flags escape into the backup RAM 44*a*.

There are provided an air flow sensor 8, a throttle sensor 9, a knock sensor 25, a coolant temperature sensor 27, an $O_2$ sensor 29, a crank angle sensor 32, a cam angle sensor 34 and a vehicle speed sensor 35 in the input port of the above I/O interface 45. The battery voltage is always monitored. Furthermore, an igniter 14 is connected to the output port of the I/O interface 45 and an ISC valve 11 a fuel injector 12, a CPC valve 24 and the relay coil of a fuel pump relay 51 are also connected to the output port of the I/O interface 45 through a driver 52.

In the ROM 43 a control program and miscellaneous fixed control data such as maps are stored and in the RAM 44, data-processed output signals from sensors and switches abovementioned and miscellaneous data computed by the CPU 42 are stored. In the backup RAM 44*a*, an air-fuel ratio learning value map and trouble codes corresponding to failed components detected by a self-diagnostic function are stored and these stored data are held therein even after power supply to the ECU 41 has been turned off.

According to the control program stored in the ROM 43, the CPU 42 calculates fuel injection amounts, ignition timings, duty ratio based on signals from the driver of the ISC valve 11 and performs miscellaneous controls such as the air-fuel ratio learning control, the ignition timing control, the idle speed control and the canister purge control.

Hereunder, operations associated with the canister purge by the ECU 41 will be explained according to the flowcharts in FIG. 1 to FIG. 5.

Figure 1:
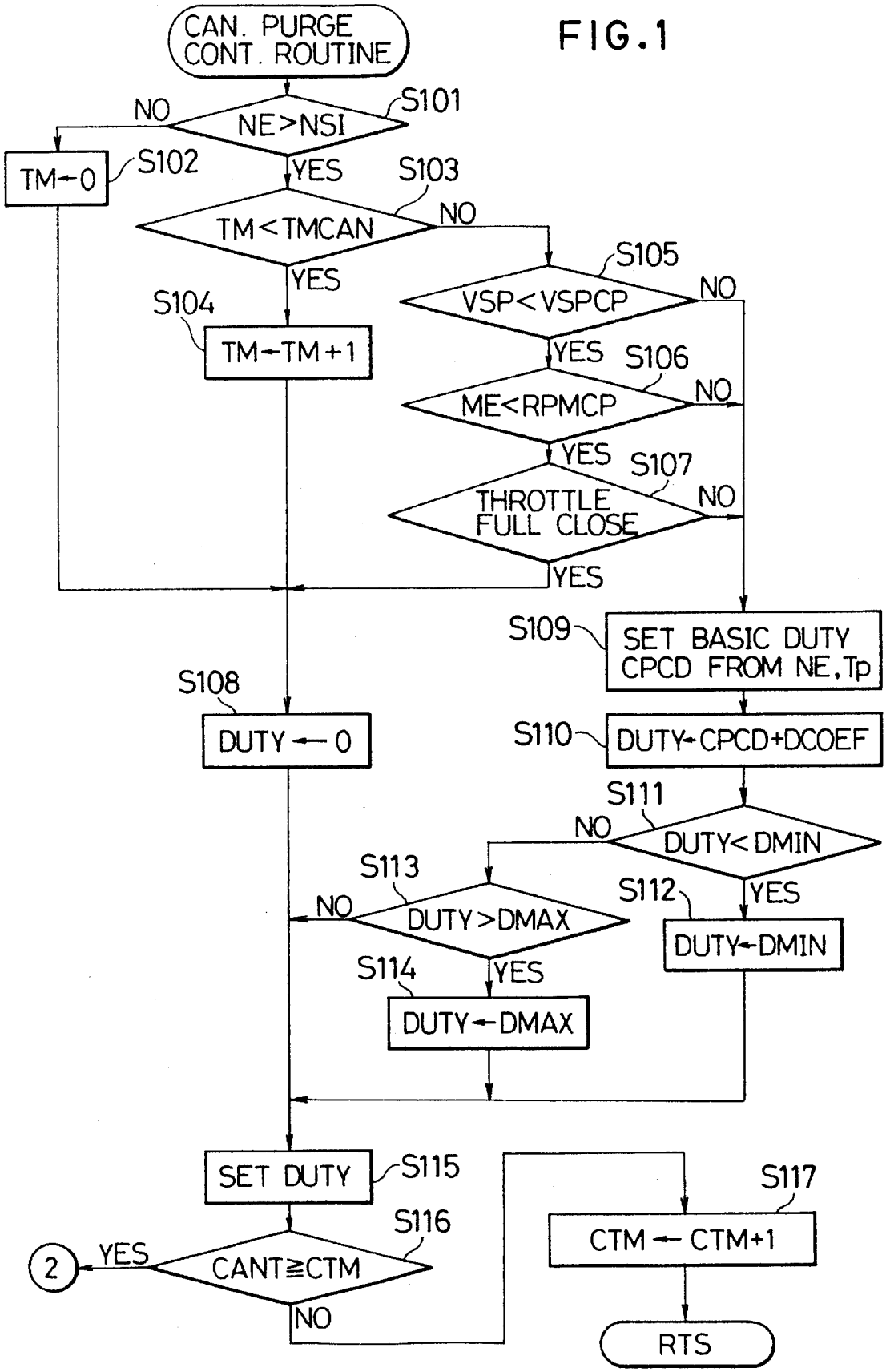
FIG. 1 is a flowchart 1 showing a canister purge control routine.

FIG. 1 indicates a canister purge control routine carried out by an interruption at a specified interval. At a step S101, an engine speed $N_E$ is compared with a firing engine speed $N_{SET}$ (for example, 300 to 500 rpm). If $N_E$ is equal to or smaller than $N_{SET}$, i.e., an engine is not yet in the firing condition or an engine is stopped, the process is diverted to a step S102 where a count value TM for counting a time after a firing start (TM=0).

On the other hand, at the step $101 where it is judged that $N_E$ is greater than $N_{SET}$, i.e., an engine is in the firing condition, the process goes from the step S101 to a step S103 where the count value TM is compared with a predetermined value TMCAN (for example, 63 secs or a correspondent). If TM is smaller than TMCAN, i.e., a predetermined time has not yet passed since an engine start, at a step S104 the count value TM is counted up and the process goes to a step S108. If TM is equal to or greater than TMCAN, i.e., a predetermined time has passed, then at steps S105, S106 and S107, it is judged whether or not the engine is at the idle condition. That is to say, a vehicle speed VSP is compared with a set vehicle speed VSPCP (for instance, 4 Km/h) at the step S105 and an engine speed $N_E$ is compared with a set engine speed RPMCP (for instance, 1000 rpm) at the step S106. Further at the step S107 it is judged whether a throttle valve is closed or not. If VSP is smaller than VSPCP and $N_E$ is smaller than RPMCP and further it is judged that a throttle valve is closed, the engine is judged to be at the idle condition and the process goes to a step S108. At the step S108, a duty ratio DUTY (hereinafter referred to as a "purge control duty") of a driving signal to the CPC valve 24 is set to 0 (DUTY=0) and at a step S115, DUTY is set, thus the routine returns to the main routine. As this routine indicates, the CPC valve 24 is closed, i.e., a canister purge is not conducted either for a predetermined time after an engine start or at the idle condition.

On the other hand, at steps S105, S106 and S107 if it is judged negatively, an engine is not in the idle condition and the process is diverted to a step S109 at which a basic duty CPCD is determined. CPCD is calculated by interpolation on a basic duty map stored in the RAM 43 based upon an engine speed $N_E$ and a basic fuel injection pulse duration $T_p$ (a fuel injection amount $T_i$ or an induction air amount Q may be used). Above basic duty map is composed of, for example, a lattice of 8×8 in which optimum values of the purge control duty DUTY parameterizing an engine speed $N_E$ and a basic fuel injection amount $T_p$ are stored as a basic duty CPCD. These optimum values of the purge control duty have been obtained by experiments or other means separately. After that, the process goes from the above step S109 to a step S110 where the basic duty CPCD determined at the step S109 is added to a correction value $D_{COEF}$ determined by the correction amount determination routine to be mentioned later and the purge control duty DUTY is rewritten by that result (DUTY=CPCD+$D_{COEF}$). At a step S111, it is checked whether this purge control duty DUTY reaches a lower limit value $D_{MIN}$ (for example, 0%). At the above step S111, if DUTY is smaller than $D_{MIN}$, at the next step S112 the purge control duty DUTY is fixed at a lower limit value $D_{MIN}$ (DUTY=$D_{MIN}$) and next at a step S115, the purge control duty DUTY fixed at $D_{MIN}$ is set, thus the routine returns to the main routine. Further, at the above step S111, if DUTY is equal to or larger than $D_{MIN}$, at a step S113 it is checked whether the purge control duty DUTY is larger than an upper limit value $D_{MAX}$. In case where DUTY is equal to or smaller than $D_{MAX}$, the purge control duty DUTY corrected at the step S110 is set at the step S115, thus the routine returns to the main routine. In case where DUTY is larger than $D_{MAX}$, a purge control duty DUTY is fixed at an upper limit value $D_{MAX}$ (DUTY=$D_{MAX}$). The DUTY thus fixed is set at the step S115.

Further at the next step S116, a timer for correction amount setting routine CTM is compared with a predetermined value CANT and if CTM is smaller than CANT, then a timer CTM is counted up at the next step S117 and the routine returns to the main routine. If CTM is equal to or larger than CANT, then the routine is diverted to a step S201 where a correction amount setting routine is executed.

Figure 3:
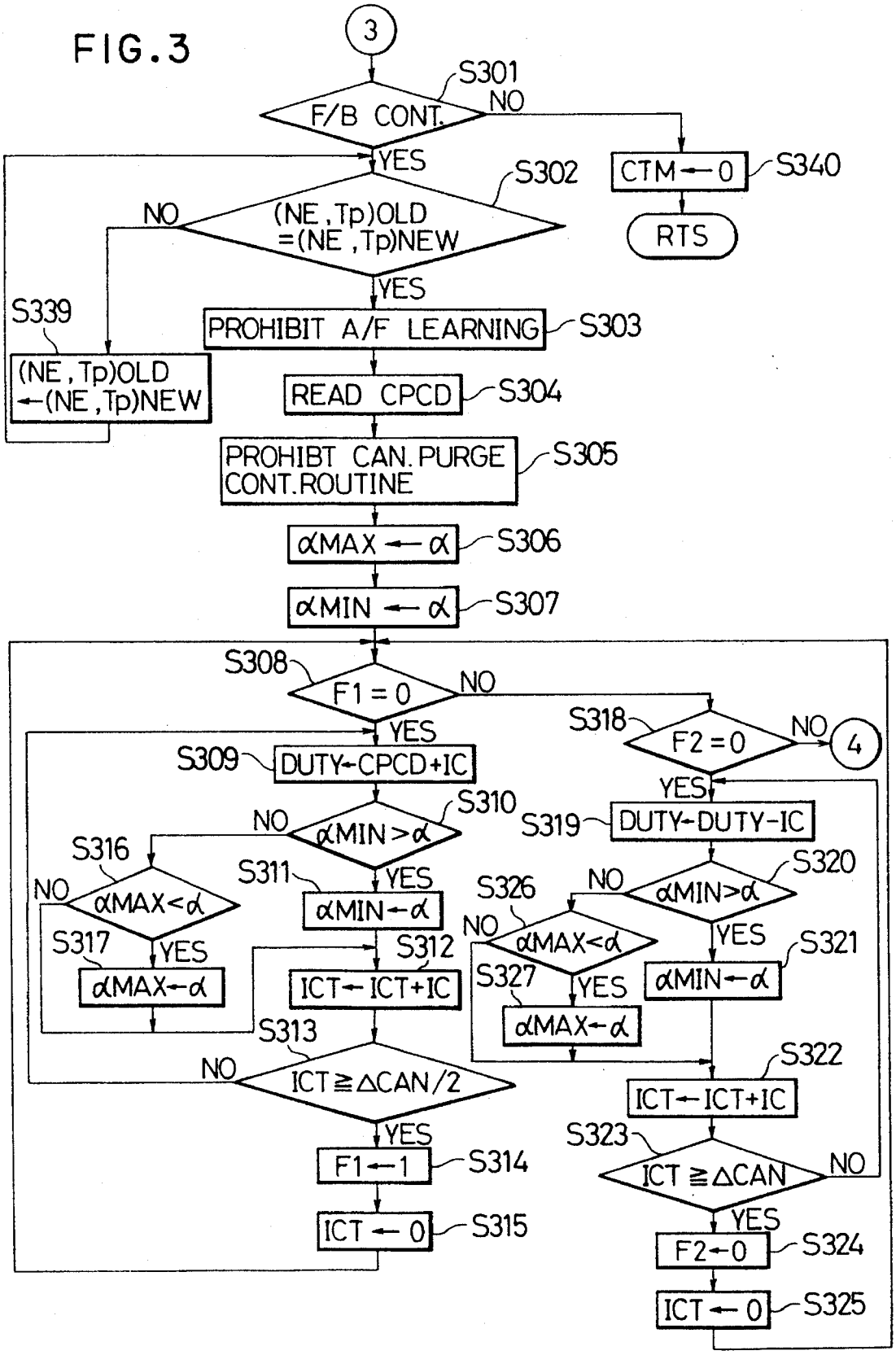
FIG. 3 is a flowchart showing a routine for varing a pourge contro duty.
Figure 4:
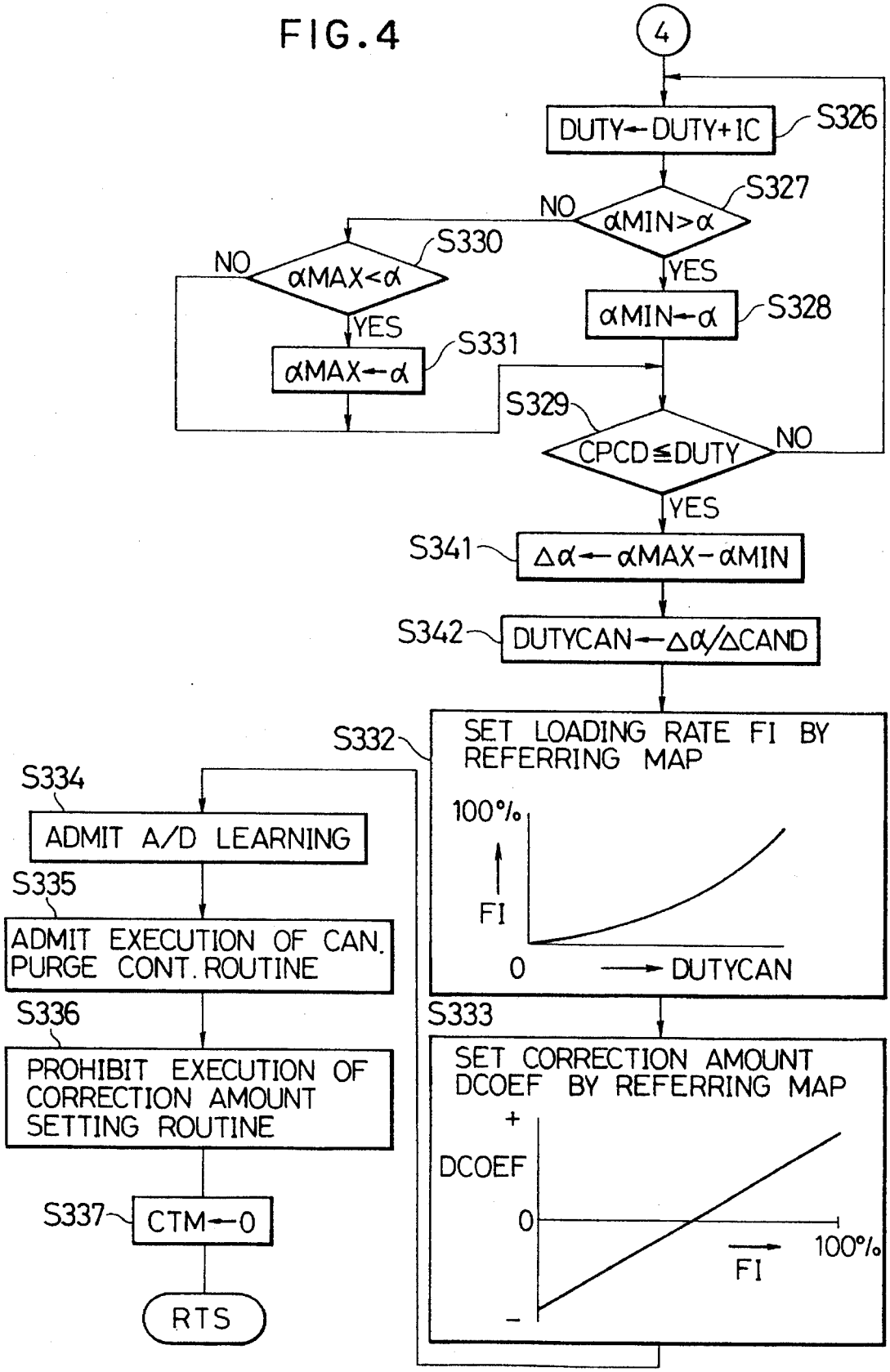
FIG. 4 is a flowchart showing a routine for determining a canister loading rate and a required purge amount.

A correction amount $D_{COEF}$ to the purge control duty DUTY is determined by a correction amount setting routine as illustrated in FIG. 3 and FIG. 4. The correction amount setting routine is executed at a specified interval when an execution of the correction amount setting admission routine as indicated in FIG. 3 is admitted. The correction amount $D_{COEF}$ is obtained by assuming a loading rate of fuel vapor in the canister 23 according to variations of an air-fuel ratio feedback correction coefficient $\partial$ when the purge control duty DUTY is forced to be varied.

On the other hand, the above air-fuel ratio feedback correction coefficient $\partial$, as it is well known, a correction coefficient of closed loop in the air-fuel ratio control. The coefficient $\partial$, is determined based on the output voltage of an $O_2$ sensor 29 through an air-fuel ratio feedback correction setting routine (refer to FIG. 5) which is executed at a specified interval.

Figure 5:
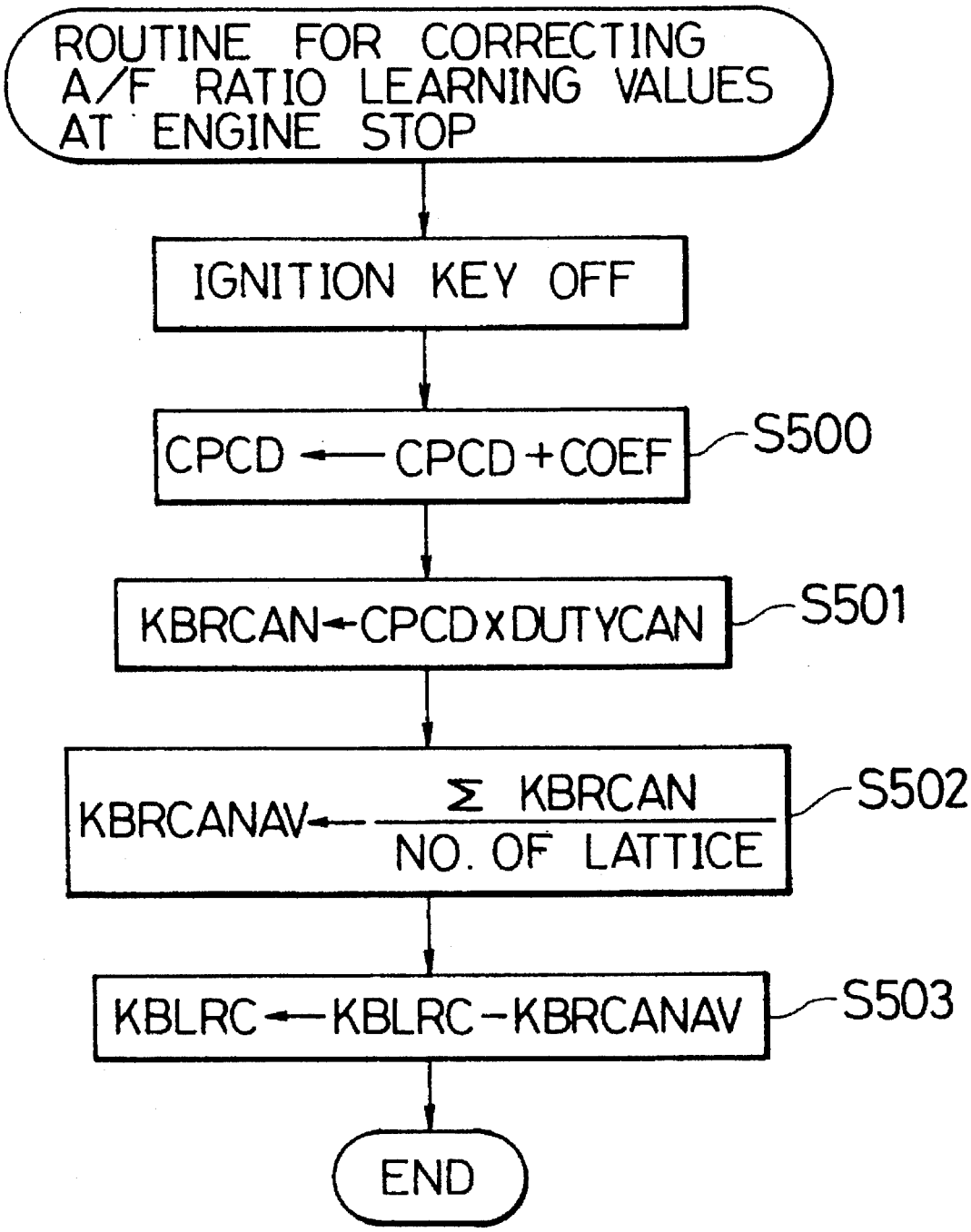
FIG. 5 is a flowchart showing a routine for correcting air-fuel ratio learning values at an engine stop.
Figure 6:
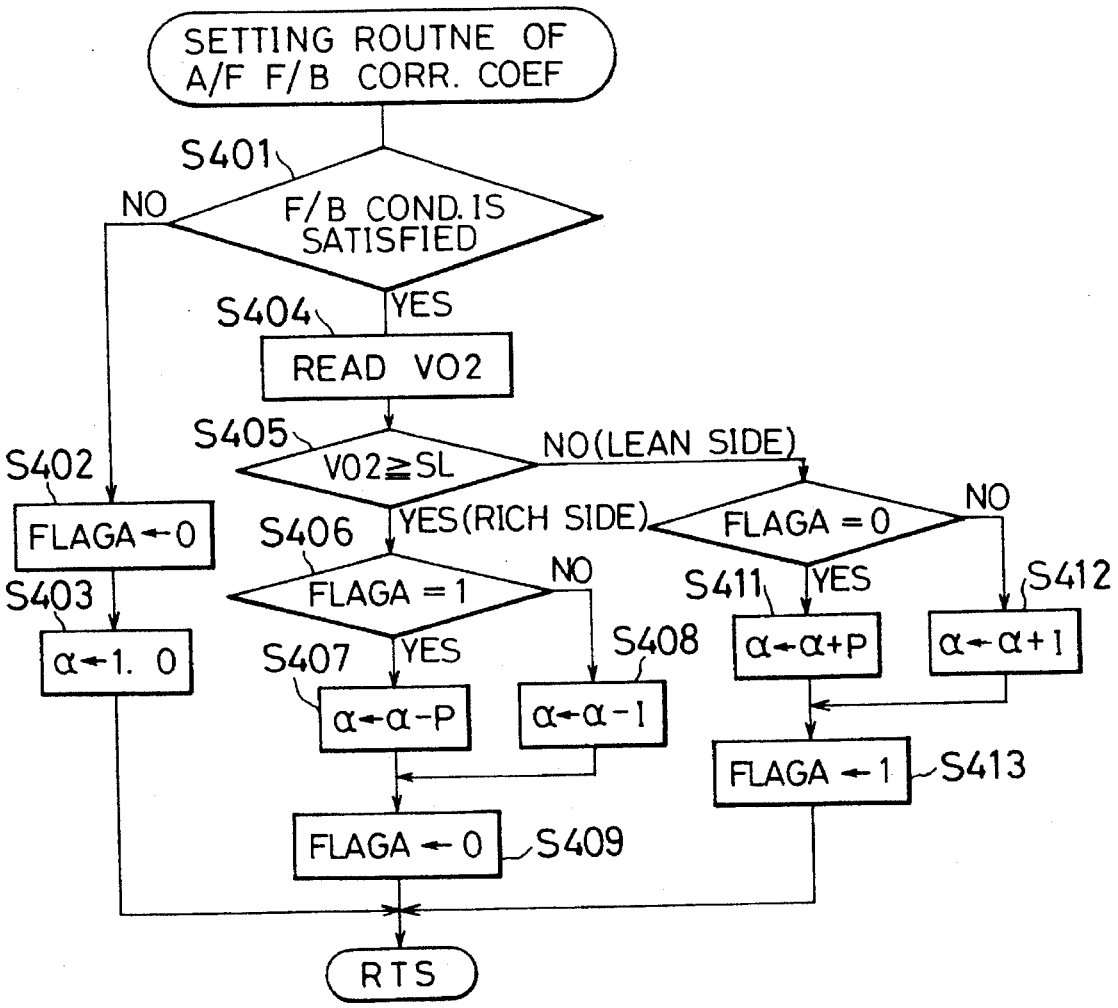
FIG. 6 is a flowchart showing a setting routine of air-fuel ratio feedback correction coefficient.

Before explaining a determination routine of the correction amount $D_{COEF}$, an air-fuel ratio feedback correction coefficient setting routine is described as follows:

FIG. 5 shows an a setting routine of the air-fuel ratio feedback correction coefficient $\partial$.

In this routine, at a step 401 it is judged whether or not a feedback control condition is satisfied based on miscellaneous factors indicating the engine operating conditions such as an engine speed $N_E$, a coolant temperature $T_W$ and a basic fuel injection amount $T_p$. For example, a feedback control condition is judged not to be satisfied either in case of the coolant temperature $T_W$ below a specified value (below 50° C. for instance, or in case of the engine speed $N_E$ above a specified value (above 5200 rpm for instance), or in case of the basic fuel injection amount $T_p$ above a specified value (a WOT zone for instance).

In other cases except above and the case where the $O_2$ sensor is activated (an output voltage of the $O_2$ sensor exceeding a specified value, the feedback control condition is judged to be met.

At the step S401, if it is judged that the feedback control condition is not satisfied, the process goes to a step S402 where a flag $FLAG_A$ for discriminating a switching of air-fuel ratio "rich to lean" or "lean to rich" is cleared ($FLAG_A$=0) and then at the next step S403 an air-fuel ratio feedback correction coefficient $\partial$ is set to 1.0, the routine is returned to the main routine. That is to say, in case where the feedback control condition is not satisfied, an air/fuel control becomes so-called open control.

On the other hand, if it is judged at the step S401 that the feedback control condition is satisfied, the process goes to a step S404 where an output voltage of the $O_2$ sensor 29, $V_{O2}$ is read and at a next step S405 it is judged if the present air-fuel ratio is on a rich side or a lean side by comparing the $V_{O2}$ with a set slice level SL.

If at the above step S405 it is judged that $V_{O2}$ is equal to or larger than SL, the process steps to a step S406 where a flag $FLAG_A$ is looked up. The flag $FLAG_A$ is changed from 1 to 0, where air-fuel ratio moves from "lean" to "rich" and the flag $FLAG_A$ is changed from 0 to 1, where air-fuel ratio transfers from "rich" to "lean."

If $FLAG_A$ is 1 at the above step S406, this indicates that air-fuel ratio has been in the rich condition, so at a next step S407 the air-fuel ratio feedback correction coefficient $\partial$ is reduced as much as proportional constant P ($\partial=\partial-P$) and then at a step S409 $FLAG_A$ is made clear ($FLAG_A=0$), thus the routine returns to the main routine.

If $FLAG_A$ is 0 at the step S406, this case indicates that the air-fuel ratio feedback correction coefficient $\partial$ has been already reduced by P, so the process goes to a step S408 where the $\partial$ is reduced as much as an integral constant I ($\partial=\partial-I$), then the routine returns to the main routine after $FLAG_A$ is made clear ($FLAG_A=0$) at the step S409.

If at the step S405 it is judged that $V_{O2}$ is smaller than SL, i.e., the air-fuel ratio is on the lean side, the process goes to a step S410 where it is judged whether the abovementioned $FLAG_A$ is set. If $FLAG_A$ is 0 at the step S410, the air-fuel ratio feedback correction coefficient $\partial$ is increased as much as a proportional constant P ($\partial=\partial+P$) at the next step S411 and if $FLAG_A$ is 1 at the step S410, i.e., the air-fuel ratio feedback correction coefficient $\partial$ has been increased by the proportional constant P, the process is diverted to a step S412 where $\partial$ is increased as much as an integral constant I ($\partial=\partial+I$). Then, the process goes to a step S413 at which $FLAG_A$ is set to 1 ($FLAG_A=1$) and the routine returns to the main routine.

The air-fuel ratio feedback correction coefficient $\partial$ determined by the above routine is used in determining a fuel injection amount $T_i$. In the ECU 41 an air-fuel ratio is established by correcting a basic fuel injection amount $T_p$ with an air induction amount Q and an engine speed $N_E$ and further by correcting it with an air-fuel ratio feedback correction coefficient $\partial$ and miscellaneous increment correction coefficients COEFs determined based on a throttle opening, coolant temperature and other engine operating conditions. Also in the feedback control of the ECU 41, in order to keep air-fuel ratio at a target value even when the engine operating condition is largely changed or even when an engine is in the open control, a learning control is introduced into the air-fuel ratio control system. The fuel injection amount corrected above is further corrected by a learning correction coefficient $K_{BLRC}$ and moreover corrected by a voltage correction coefficient TS so as to correct an invalid injection time of the injector 12. Thus, the final injection amount $T_i$ is determined as follows:

$$T_i=T_p\times\partial\times COEF\times K_{BLRC}+TS$$

Figure 2:
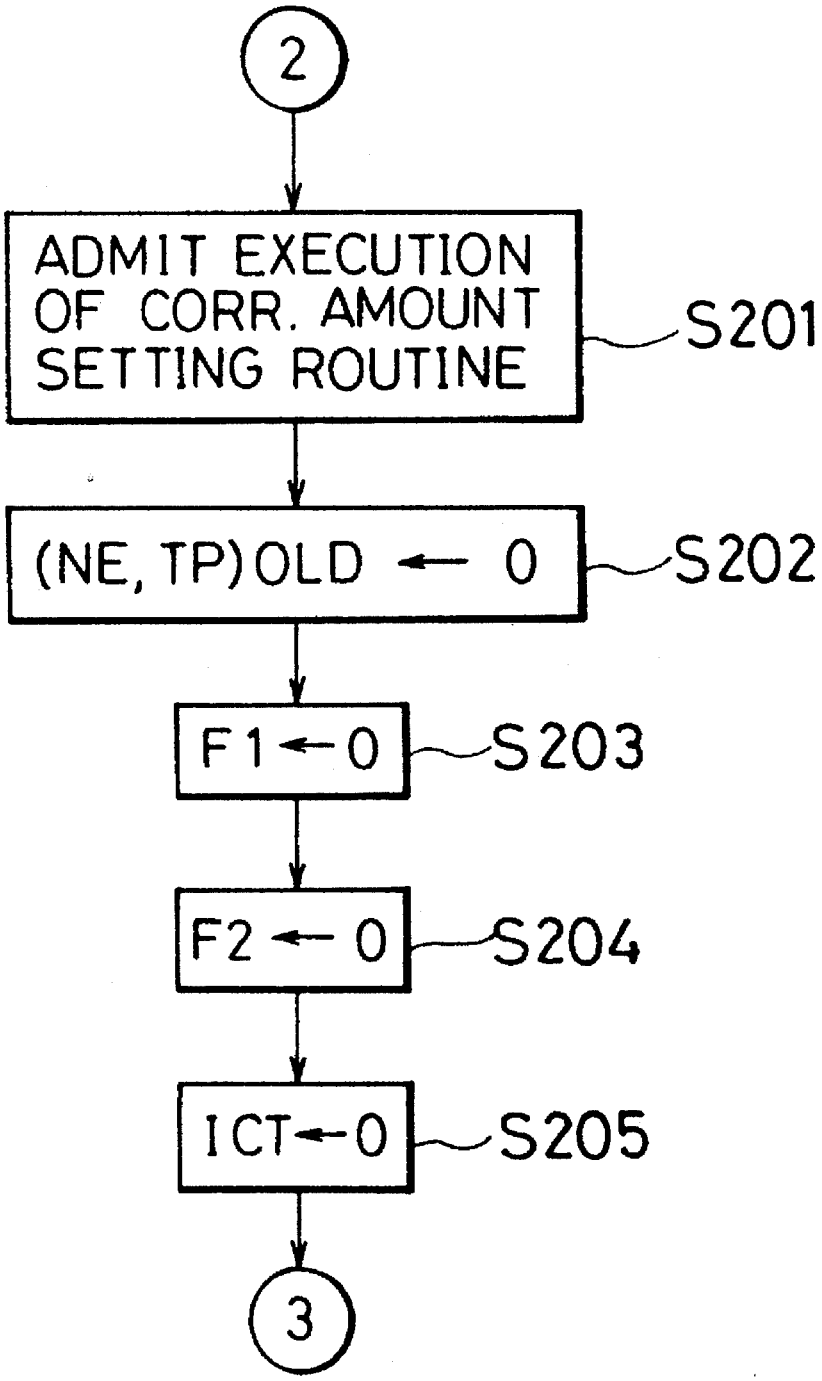
FIG. 2 is a flowchart 2 showing an admission of an execution of correction amount setting routine.

FIG. 2 shows an execution admission routine for correction amount setting. This routine is carried out at a relatively longer interval. When at a step S201 an execution of the correction amount setting is admitted, at steps S202, S203, S204 and S205 the data and flags used in the correction amount setting routine are cleared respectively. Namely, at the step S202, an area data $(N_E, T_p)_{OLD}$ in the steady state judging matrix is cleared ($(N_E, T_p)_{OLD}=0$) and an addition flag F1 is cleared (F1=0) at a step S203. The addition flag F1 is one for ordering to increase a purge control duty DUTY as much as an $I_C$ (purge control integral constant) when checking a change of an air-fuel ratio correction coefficient $\partial$ by changing the purge control duty DUTY for a specified time. At the next step S204 subtraction flag F2 is cleared (F2=0). The subtraction flag F2 is one for ordering to decrease a purge control duty DUTY as much as an $I_C$.

Further at a step S205 an $I_{CT}$ (an integrating value of purge control integral constants) is cleared ($I_{CT}=0$) and then this process goes to a step S301.

If both F1 and F2 are equal to 0, a purge control duty DUTY is ordered to be initialized. When the purge control duty DUTY has been initialized, F1 is set to I and a purge control integral constant $I_C$ is added to the purge control duty DUTY. In ¼ cycle after the purge control duty DUTY is increased, the above subtraction flag F2 is set to 1. After ¼ cycle, the purge control duty DUTY is reduced by the purge control integral constant $I_C$. Further in ¾ cycle, the above addition flag F1 is set to 0 and the purge control duty DUTY is increased by the purge control integral constant $I_C$ again, thus 1 cycle is finished.

Once the purge correction amount setting routine is permitted to be carried out by the purge correction admission routine, this routine, as shown in FIG. 3, is executed at a predetermined time interval.

The purge correction amount setting routine is carried out as follows:

First, at a step S301 it is judged whether an engine is under the feedback control or not. If it is not, the process is diverted to a step S340 where a timer CTM is cleared (CTM=0) and the routine returns to the main routine. If it is judged that an engine is under the feedback control, the process goes to a step S302 and there it is judged whether or not the present area data $(N_E, T_p)_{NEW}$ of a matrix which is formed with an engine speed $N_E$ and a basic fuel injection pulse duration $T_p$ is the same as the previous area data $(N_E, T_p)_{OLD}$ which is read from the RAM 44. In case where previous data $(N_E, T_p)_{OLD}$ read from the RAM differs from the present area data $(N_E, T_p)_{NEW}$, the case means that the present routine is the first execution after the purge correction amount setting routine is permitted, or an engine is not in the steady operating condition and in this case the process is diverted to a step S339 where the present data $(N_E, T_p)_{NEW}$ is rendered to the previous data $(N_E, T_p)_{OLD}$ ($(N_E,T_p)_{OLD}=(N_E, T_p)_{NEW}$) and then the process returns to the step S302 after the updated data is stored in the RAM 44.

At the above step S302, if the previous area data $(N_E, T_p)_{OLD}$ is the same as the present area data $(N_E, T_p)_{NEW}$, it is judged that an engine is in the steady operating condition and the process goes to step S303.

At the step S303, an air-fuel ratio learning is prohibited in order that variation of air-fuel ratio is not learned unnecessarily when the air-fuel ratio varies as the purge control duty is rendered to be changed at the steps mentioned after S309.

At the next step S304 a basic duty CPCD is read and further at the step S305 an execution of the canister purge control routine is prohibited in order that the purge control duty is not controlled by the canister purge control routine.

At the next steps S306 and S307, the present value of $\partial$ is set as $\partial_{MAX}$ and $\partial_{MIN}$ and stored in the RAM 44 respectively. Where F1 is equal to 1 at the above step S308, this case means that the initial value for purge control duty was established at the previous routine and thus the process is diverted to a step S318. On the other hand, where F1 is equal to 0 at the above step S308, this case means that both addition flag F1 and reduction flag F2 have been cleared, i.e., the process is in the initial condition. Therefore, the change of purge control duty DUTY starts hereupon. First, at a step S309 an integral constant $I_C$ is added to the basic duty CPCD fixed at the step S304 and the sum is set as a purge control duty DUTY ($DUTY=CPCD+I_C$).

Next, stepping to the step S310, the present air-fuel ratio feedback coefficient $\partial$ is compared with the $\partial_{MIN}$ stored in the RAM 44. If $\partial$ is smaller than $\partial_{MIN}$, $\partial$is set as $\partial_{MIN}$ ($\partial=\partial_{MIN}$) and stored in the RAM 44. If $\partial$ is equal to or larger than $\partial_{MIN}$ at the step S310, $\partial$ is compared with the $\partial_{MAX}$ stored in the RAM 44 at a step S316. If $\partial$ is larger than $\partial_{MAX}$, at the next step S317 $\partial$ is set as $\partial_{MAX}$ ($\partial=\partial_{MAX}$) and stored in the RAM 44.

At a step S312 the present purge control integral constant $I_C$ is added to the previous integral value $I_{CT}$ and the $I_{CT}$ is renewed ($I_{CT}=I_{CT}+I_C$).

Figure 9:
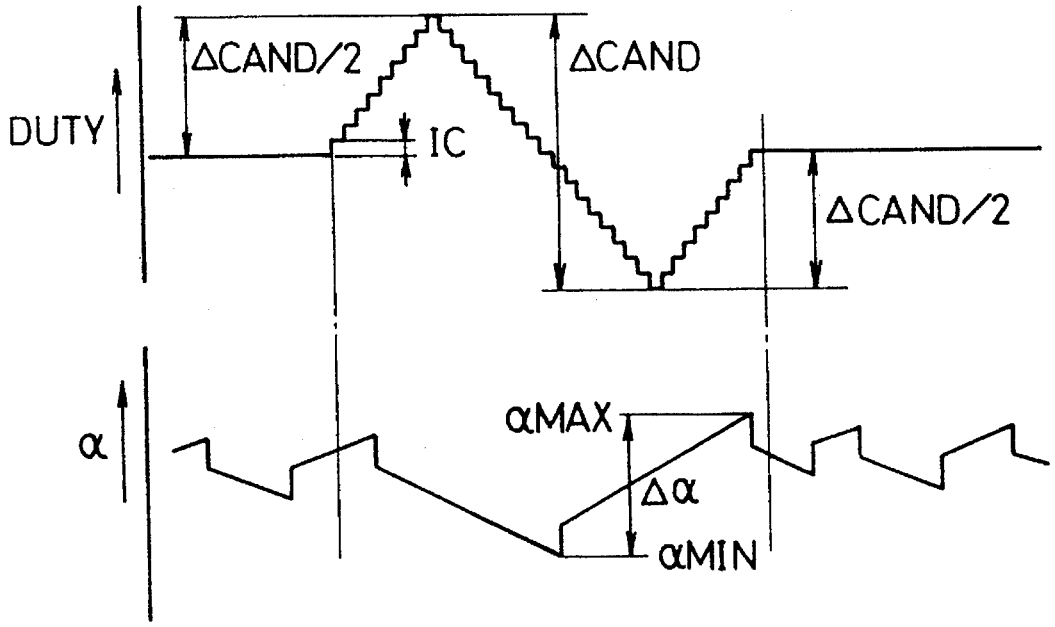
FIG. 9 is a graphical illustration indicating variations of a feedback correction coefficient against variations of a purge control duty.

At the next step S313 it is judged whether or not this $I_{CT}$ is above ½ of a predetermined value ΔCAND. The ΔCAND is a span of change for the purge control duty DUTY in one cycle, as illustrated in FIG. 9 and the half (½) of ΔCAND is assumed to be a change of DUTY corresponding to ¼ cycle.

Accordingly, when the integral value $I_{CT}$ which is renewed at each execution of this purge correction routine reaches ½ of the above predetermined value ΔCAND, it is known that ¼ cycle has been finished. After ¼ cycle the purge control duty DUTY is continued to be subtracted by an $I_C$ each time the purge correction routine is carried out until ¾ cycle and then after ¾ cycle the purge control duty DUTY is continued to be added by an $I_C$ again until 1 cycle is finished.

Therefore, at the step S313, in case where $I_{CT}$ is smaller than ΔCAND/2, the purge control duty DUTY is on the way of being changed towards ¼ cycle from an initial condition, the process returning to a step S309 from the step S313 and again repeating S309 to S313.

At the step S313, in case where $I_{CT}$ is equal to or larger than ΔCAND/2, this case shows that the cycle of DUTY change reaches ¼ cycle and the process returns to the step S308 after setting the addition flag F1 into 1 (F1=1) at a step S314 and clearing the integral value $I_{CT}$ ($I_{CT}=0$) at the next step S315.

At the step S308 the addition flag F1 is looked up again. If F1 is equal to 1 at the above step S308, the process is diverted to a step S318 where the subtraction flag F1 is looked up. If F2 is equal to 0, i.e., F1=1 and F2=0, this case indicates that the cycle of DUTY change reaches ¼ cycle after the increasing process following initialization, so that the process goes to a step S319 where the purge correction duty DUTY is subtracted by an integral constant $I_C$ and is set (DUTY=DUTY−$I_C$). At the steps following S320, a maximum and minimum values of the air-fuel ratio feedback correction coefficient ∂ are detected and at a step S322, the integral value $I_{CT}$ is added by an integral constant $I_C$ and is set as an $I_{CT}$ ($I_{CT}=I_{CT}+I_C$).

At a step S323, it is judged whether or not the integral value of integral constants $I_{CT}$ reaches a predetermined value ΔCAND, or a span of change for the purge control duty DUTY. If $I_{CT}$ is smaller than ΔCAND, the process passes to a step S319 and the process from S319 to S323 are repeated. If $I_{CT}$ is equal to or larger than ΔCAND, at a step S324 a subtraction flag F2 is set as 1 and at a step S325 the process returns to the step S308 after the integral value $I_{CT}$ is cleared ($I_{CT}=0$).

At a step S320, an air-fuel ratio correction coefficient ∂ is compared with $2_{MIN}$. Where ∂ is smaller than $\partial_{MIN}$, ∂ is set and stored as $\partial_{MIN}$ in the RAM 44.

On the other hand, at the above step S318, in case where F2 is equal to 1, i.e., both the addition flag F1 and the subtraction flag F2 are set, since this case indicates that the purge control duty DUTY has been continued to be decreased for ¾ cycle, i.e., ¾ cycle has been finished, the purge control duty DUTY is increased at steps following S326 and the process goes for performing detections of a maximum and minimum values of an air-fuel ratio correction coefficient.

As shown in FIG. 9, an air-fuel ratio feedback correction coefficient ∂ changes to the lean direction with a certain time lag, when a purge control duty DUTY is increased from the initial condition, because the amount of fuel vapor purged from the canister 23 to an engine is increased as the valve opening of a CPC valve 24 becomes large. However, the air-fuel ratio feedback correction coefficient ∂ turns to the rich direction near ½ cycle, when the purge control duty DUTY is decreased after ¼ cycle, because the amount of fuel vapor purged from the canister 23 to an engine is decreased as the valve opening of the CPC valve 24 becomes small.

After at a step S326 a purge control duty DUTY is set, at steps S327, S328, S330 and S331 a maximum and minimum values for air-fuel ratio feedback correction coefficient ∂ are obtained.

After that, at a step S329 the present value of the purge control duty DUTY is compared with a fixed value CPCD. If CPCD is equal to or smaller than DUTY, it is deemed that 1 cycle for duty change has been finished and the process goes to a step S341. Otherwise if CPCD is greater than DUTY, the duty change is deemed to be on the way and the process starting from the step S326 is repeated.

At the step S341, a maximum and minimum value ($\partial_{MAX}$ and $\partial_{MIN}$) for air-fuel ratio feedback correction coefficient determined at the above steps S328 and S331 and stored in the RAM 44 are read from the RAM 44 and according to these values, a span of change for the air-fuel ratio feedback correction coefficient ∂, denoted as Δ∂ is calculated ($\Delta\partial=\partial_{MAX}-\partial_{MIN}$)

At the next step S342, a change rate of per unit duty DUTYCAN is obtained by dividing a Δ∂ by a predetermined value ΔCAND (DUTYCAN=Δ∂/ΔCAND) and stored in the RAM.

The process steps from S342 to S332 where a canister loading rate FI is determined by finding a FI corresponding to the DUTYCAN obtained above by use of interporation on a canister loading rate map. The FI thus determined is assumed as a present loading rate of the canister 23. The above canister loading rate map is prepared as follows:

First, fuel vapor is charged to several canisters with appropriate loading rates ranging 0% to 100%. Next, a canister purge is performed on each of these canisters and a change rate of ∂ per unit duty DUTYCAN is obtained for each canister according to the steps above mentioned. Finally, a relationship between loading rate and DUTYCAN is plotted on a map. At the next step S333, a correction amount $D_{COEF}$ is determined by looking up a correction amount map based upon the above canister loading rate FI. The correction amount $D_{COEF}$ is a correction amount to the purge control duty DUTY so as to avoid an inappropriate air-fuel ratio due to the canister purge.

As another embodiment, the above step S332 may be omitted and in place such a map as indicating a relation directly between the DUTYCAN and the $D_{COEF}$ corresponding to the canister loading rate FI may be provided.

At the steps S334, S335 and S336 the air-fuel learning admission, the canister purge control routine admission and the correction amount setting routine prohibition are conducted respectively and then the process returns to the main routine. The above correction amount map, as shown in S333, indicates a relationship between the correction amount $D_{COEF}$ and the canister loading rate FI and it is stored in the ROM 43. In this embodiment, above 50 per cent of the canister loading rate FI the correction amount $D_{COEF}$ is a positive correction amount and below 50 per cent of the canister loading rate FI the correction amount $D_{COEF}$ is a negative correction amount. As a result of this, at the step S111 in case where a canister 23 is loaded with less amount of fuel vapor, the purge control duty DUTY is corrected in the negative direction to the basic duty CPCD and in case where the canister 23 is loaded with larger amount of fuel vapor, the purge control duty DUTY is corrected in the positive direction to the basic duty COCD.

FIG. 5 illustrates a routine for correcting air-fuel ratio learning values at an engine stop. When an ignition key switch is turned off, the steps following S500 are performed.

At the step 500, a correction amount $D_{COEF}$ is added to each of the basic duty CPCD values which are stored in the ROM 43 ($CPCD=CPCD+D_{COEF}$) and those updated CPCD values are stored in the RAM 44. At the next step S501, a learning value of air-fuel ratio deviation by canister purge $K_{BRCAN}$ is calculated to each of those updated CPCD values ($K_{BRCAN}=CPCD \times DUTYCAN$) and stored in the RAM 44.

Further at a step S502, a $K_{BRCANAV}$ is calculated by averaging those $K_{BRCAN}$ values.

Finally at the last step S503, an air-fuel ratio learning value $K_{BLRC}$ stored in the backup RAM 44*a* is subtracted by the $K_{BRCANAV}$ obtained above and this subtraction is performed for every $K_{BLRC}$ value in an air-fuel ratio learning value map. The $K_{BLRC}$ values thus obtained are restored in the backup RAM 44*a* and then electric power is turned off.

In summary, the present invention provides a canister purge control system having following features:

First, determining an appropriate purge amount from the loading condition of a canister and controlling a canister purge so as not to cause an over-loading of canister under any temperature, altitude, fuel and engine operating conditions, and secondly correcting a deviation of air-fuel ratio learning value caused by a canister purge at an engine stop, whereby improving an engine startability, a driveability and emissions performance.

While the presently preferred embodiment of the present invention has been shown and described, it is to be understood that this disclosure is for the purpose of illustration and that various changes and modifications may be made without departing from the scope of the invention as set forth in the appended claims.

I claim:

1. A method for controlling canister purge of an internal combustion engine having a purge control system for purging fuel vapor vaporized in a fuel tank into the engine, an air-fuel feedback control system having an $O_2$ sensor for controlling a fuel injection amount at a desired value according to a basic fuel injection amount based on detected engine operating conditions and an air-fuel ratio correcting coefficient based on a signal from said $O_2$ sensor, the method comprising:

changing an amount of purging fuel during a predetermined period;

calculating a variation of said air fuel-ratio correcting coefficient corresponding to said changing of purging fuel;

assuming a canister loading rate according to said variation of said air-fuel ratio correcting coefficient;

determining the purge amount of fuel vapor based on said assumed canister loading rate; and controlling a canister purge according to said assumed canister loading rate.

2. The method according to claim 1, further comprising:

determining the engine is in a steady engine operating condition;

changing a duty of purge control valve to change the amount of purging fuel so as to calculate a variation for an air fuel ratio correction coefficient;

assuming a canister loading ratio by using a map parameterizing variation of said air-fuel ratio correction coefficient; and determining a purge amount by using a map parameterizing said loading rate.

3. The method according to claim 1, further comprising:

assuming a canister loading ratio by using a formula parameterizing said variation of said air-fuel ratio correction coefficient; and determining a purge amount by using a formula parameterizing said loading rate.

4. The method according to claim 1, further comprising the steps of:

determining a purge amount by using a map parameterizing a change rate of an air-fuel ratio correction coefficient directly.

5. The method according to claim 1, further comprising the steps of:

determining a purge amount by using a formula parameterizing a change rate of an air-fuel ratio correction coefficient directly.

6. A method for controlling canister purge of an internal combustion engine having a purge control system for controlling purging of fuel vapor vaporized in a fuel tank, an air-fuel feedback control system for controlling air-fuel ratio at a desired value based on a basic fuel injection amount, corrected fuel injection amount corrected by detected engine operating conditions, and an air fuel ratio learning control system storing a plurality of air-fuel ratio learning values at each address of a memory to correct a deviation of a centerline of the feedback control in a plurality of operating conditions, the method comprising:

storing fuel purge control signals for said plurality of operating conditions:

detecting an engine stop;

calculating a plurality of deviations of air-fuel ratio learning value derived from said fuel purge control signals for all addresses corresponding to said plurality of operating conditions at an engine stop;

averaging said plurality of deviations of air-fuel ratio learning value;

subtracting an averaged deviation from each of said air-fuel ratio learning value for all addresses; and storing said subtracted air fuel ratio learning value to each corresponding address of said memory so as to improve startability of the engine.

7. The method according to claim 6, further comprising the steps of:

calculating a deviation of air-fuel ratio learning value derived from said canister purge for all addresses at an engine stop;

subtracting said calculated deviation value from an air-fuel ratio correction learning value for all addresses;

updating said air-fuel ratio correction learning value with said subtracted air-fuel ratio correction learning value for each corresponding address; and holding an electrical power supply to an ECU for a specified time after an engine stop so as to rewrite said an air-fuel ratio correction learning value.

8. A control method for an canister purge of an internal combustion engine mounted on a vehicle having, an intake pipe for inducing air into a cylinder of said engine, a fuel system for supplying fuel from a fuel tank to said engine, a vapor passage connected between said fuel tank and said intake pipe for purging fuel vapor, a canister provided in said vapor passage for absorbing said fuel vapor, and a purge control valve provided between said canister and said intake pipe for controlling a purge amount of said fuel vapor, an exhaust pipe connected to said cylinder for discharging an exhaust gas, an $O_2$ sensor inserted in said exhaust pipe for sensing an oxygen concentration in said exhaust gas, an engine speed sensor for detecting an engine speed and for generating an engine speed signal, a temperature sensor for sensing a coolant temperature in a water jacket of said engine and for producing a temperature signal, and a controller responsive to said engine speed and temperature signals for controlling said engine in an optimum condition, the method comprising:

judging whether said engine is operated in a steady operating condition or not from said engine speed and temperature signals;

stopping a learning control of an air-fuel ratio when said engine is in said steady operating condition;

prohibiting a purge control of said fuel vapor to said intake pipe;

changing a duty ratio of said purge control valve;

calculating a changing amount of said air-fuel ratio corresponding to a changing value of said duty ratio;

estimating a canister loading rate dependent on said changing amount; and controlling said purge control valve in order to set said duty ratio at an optimum value derived from a function of said canister loading rate so as to avoid a deviation of said air-fuel ratio from a standard stoichiometric ratio and to effectively improve driveability of said vehicle and emissions performance.

* * * * *